US007066085B2

(12) United States Patent
Fukunaga et al.

(10) Patent No.: US 7,066,085 B2
(45) Date of Patent: Jun. 27, 2006

(54) METHOD OF MANUFACTURING OPERATION PANEL FOR PRINTER

(75) Inventors: Yuzo Fukunaga, Nagoya (JP); Michifumi Ishigami, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/647,533

(22) Filed: Aug. 26, 2003

(65) Prior Publication Data

US 2004/0038004 A1 Feb. 26, 2004

(30) Foreign Application Priority Data

Aug. 26, 2002 (JP) ..... 2002-245006

(51) Int. Cl.
*B41M 3/16* (2006.01)

(52) U.S. Cl. ..... 101/41; 101/490; 101/129; 434/113

(58) Field of Classification Search ..... 101/35, 101/41, 114, 127, 127.1, 129, 490, 491; 434/113; 400/109.1, 128
See application file for complete search history.

(56) References Cited

U.S. PATENT DOCUMENTS

| | | | | |
|---|---|---|---|---|
| 4,063,665 | A * | 12/1977 | Schneider et al. | 222/129 |
| 4,776,270 | A * | 10/1988 | Kumamoto | 101/35 |
| 5,649,480 | A * | 7/1997 | Yim | 101/129 |
| 5,740,730 | A * | 4/1998 | Thompson, Sr. | 101/127 |
| 5,779,482 | A * | 7/1998 | Fukumoto | 434/113 |

FOREIGN PATENT DOCUMENTS

| | | | |
|---|---|---|---|
| CN | 2393144 Y | | 8/2000 |
| DE | 3720702 A1 | | 1/1989 |
| EP | 0949083 A1 | | 10/1999 |
| JP | U-60-188665 | | 12/1985 |
| JP | A 8-52929 | | 2/1996 |
| JP | 8-324575 | * | 12/1996 |
| JP | A-10-171344 | | 6/1998 |
| JP | A-10-207597 | | 8/1998 |
| JP | A 10-340049 | | 12/1998 |
| JP | A-11-301087 | | 11/1999 |
| JP | A-2000-200136 | | 7/2000 |
| JP | 2001-209299 | * | 8/2001 |
| JP | A-2001-232928 | | 8/2001 |
| JP | 2001-318593 | * | 11/2001 |
| JP | 2002-36713 | * | 2/2002 |
| WO | WO 94/00301 | * | 1/1994 |

* cited by examiner

*Primary Examiner*—Leslie J. Evanisko
(74) *Attorney, Agent, or Firm*—Oliff & Berridge, PLC

(57) ABSTRACT

A molded product for an operation panel 1 is produced by injection molding or the like. A set of characters 7 indicative of the type of each operation switch 17 is formed, by a screen printing process, at a location near to the subject switch opening portions 6. Next, another screen printing process is executed to form a set of Braille dots 12 indicative of each set of characters 7 at a location overlapping the subject set of characters 7. Accordingly, sticking spaces which are required in the case of sticking seals of the Braille dots 12 are unnecessary any more. The Braille dots 12 can be arranged freely in a narrow space. Even though the surface 3 of the operation panel 1 is curved, it is ensured that the Braille dots 12 be arranged in a secured layout, unlike the case of sticking a Braille tape on the surface 3.

1 Claim, 6 Drawing Sheets

METHOD OF MANUFACTURING OPERATION PANEL FOR PRINTER

BACKGROUND OF THE INVENTION

1. Field of the Invention

The present invention relates to a method of manufacturing a molded component, such as an operation panel for an electronic device, such as a printer, scanner, a facsimile machine, or the like.

2. Description of Related Art

On an operation panel or the like of an electronic device such as a printer, scanner, facsimile machine, or the like, characters are printed to enable a user to easily manipulate the operation panel.

SUMMARY OP THE INVENTION

It is preferable that not only the characters but also Braille dots be provided on the operation panel.

Japanese Patent unexamined Application Publication KOKAI No. 8-52929 discloses a Braille seal. The Braille seal is produced by printing ultraviolet curing resin on a vinyl chloride sheet with use of a silk screen, and by irradiating ultraviolet light onto the ultraviolet curing resin so that the ultraviolet curing resin cures to form Braille projection dots.

In many electronic devices, however, the operation panel is provided with a plurality of operation switches in order to make compact the entire size of the electronic device. Therefore, it is often difficult to secure spaces for sticking Braille seals on the surface of the operation panel.

In addition, when manufacturing electronic devices, much labor is taken to stick Braille seals to every device, causing difficulties in improving productivity.

Further, the seals will tend to be wrinkled when they are stuck to the surface of the operation panel. The seals will likely be peeled from their peripheries off the operation panel.

In view of the above-described drawbacks, it is an objective of the present invention to provide a method of manufacturing, with high productivity, a molded component such as an operation panel provided with protrusions such as Braille dots.

In order to attain the above and other objects, the present invention provides a molded component, comprising: a molded member; and a protrusion printed on a surface of the molded member.

According to another aspect, the present invention provides an operation panel, comprising: a molded component including a molded member and a protrusion printed on a surface of the molded member; and an operation portion received by the molded member for receiving a user's manipulation.

According to another aspect, the present invention provides an electronic device, comprising: a housing; an operation panel mounted to the housing, the operation panel including: a molded component including a molded member and a protrusion printed on a surface of the molded member; and an operation portion received by the molded member for receiving a user's manipulation; and an electronic unit mounted in the housing and executing a predetermined electronic operation in response to the user's manipulation of the operation portion.

According to another aspect, the present invention provides a method of producing a molded component, comprising: printing a character on a surface of a molded member; and printing a protrusion on the surface of the molded member, on which the character has already been printed.

BRIEF DESCRIPTION OF THE DRAWINGS

The above and other objects, features and advantages of the invention will become more apparent from reading the following description of the preferred embodiments taken in connection with the accompanying drawings in which:

FIG. 1(*b*) is a block diagram showing a control portion provided in the laser printer of FIG. 1;

FIG. 5(*b*) illustrates an enlarged cross-section of another screen sheet used during the screen printing step of FIG. 2(*d*)

DETAILED DESCRIPTION OF THE PREFERRED EMBODIMENT

Figure 1A:
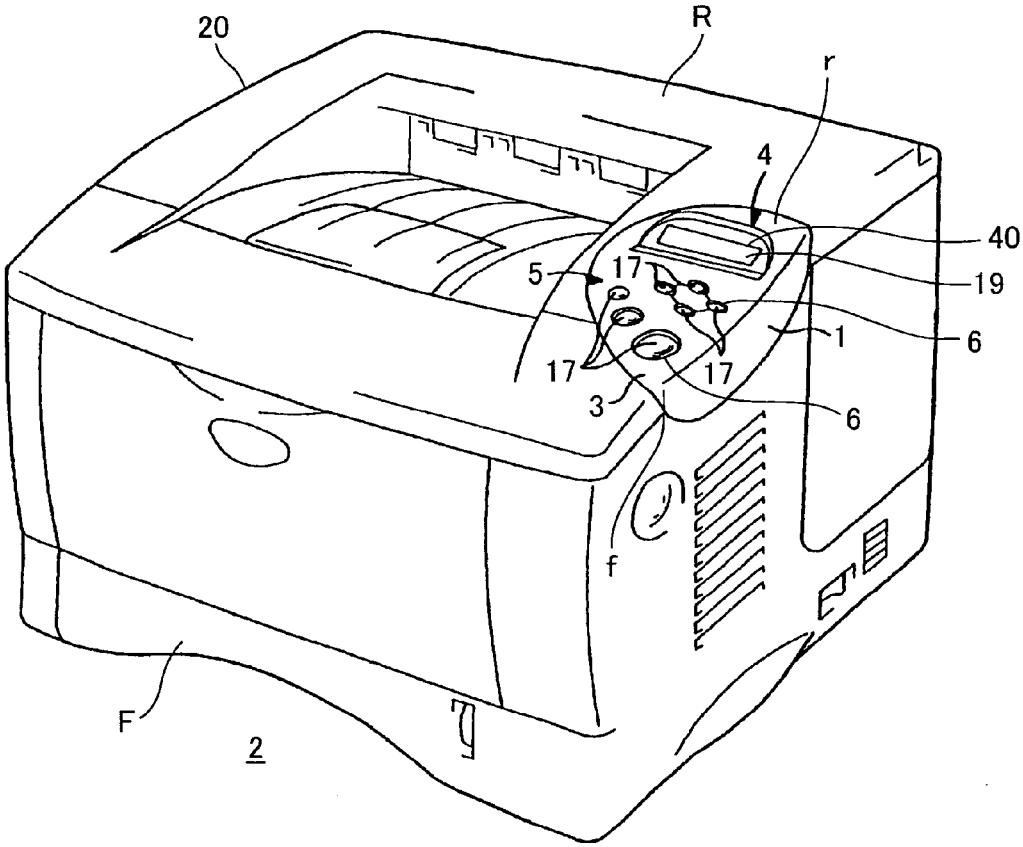
FIG. 1(*a*) is a perspective view of a laser printer mounted with an operation panel according to a preferred embodiment of the present invention.

A molded component manufacturing method according to a preferred embodiment of the present invention will be described while referring to the accompanying drawings wherein like parts and components are designated by the same reference numerals to avoid duplicating description.

Figure 1B:
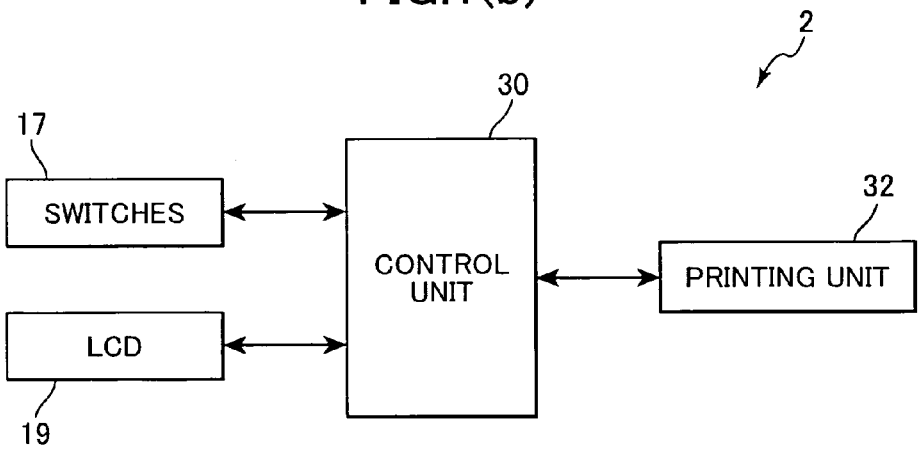
Figure 2A:
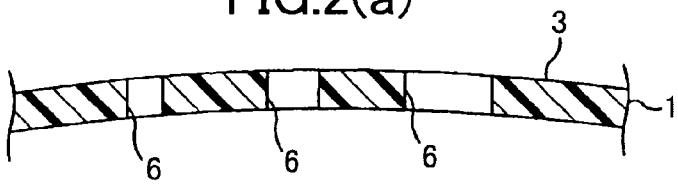
FIGS. 2(*a*)–2(*e*) illustrate a series of manufacturing steps for manufacturing the operation panel of FIG. 1(*a*) according to the present embodiment, wherein FIG. 2(*a*) shows a step of preparing the operation panel through a molding process, FIG. 2(*b*) shows a screen printing step for printing characters on the operation panel, FIG. 2(*c*) shows a step of drying the printed characters, FIG. 2(*d*) shows a screen printing step for printing Braille dots, and FIG. 2(*e*) shows a step of hardening the Braille dots by irradiation of ultraviolet rays.
Figure 2B:
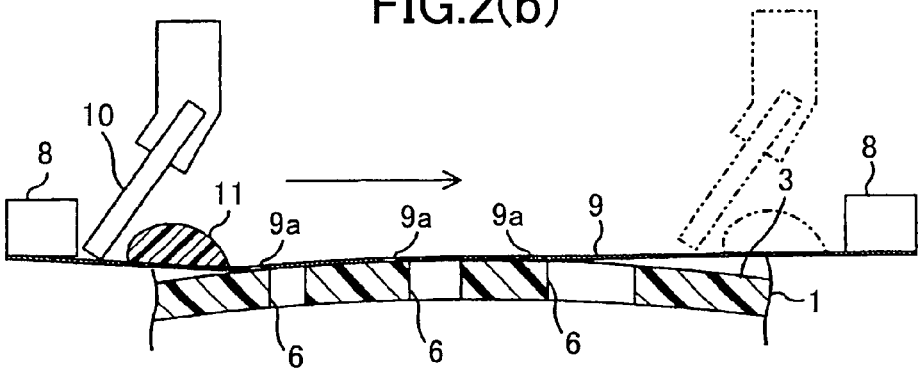
Figure 2C:
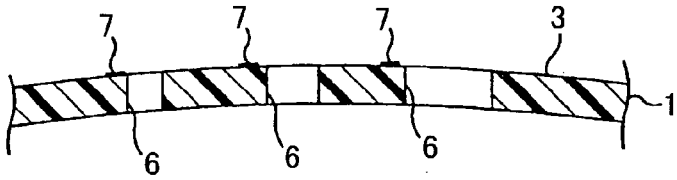
Figure 2D:
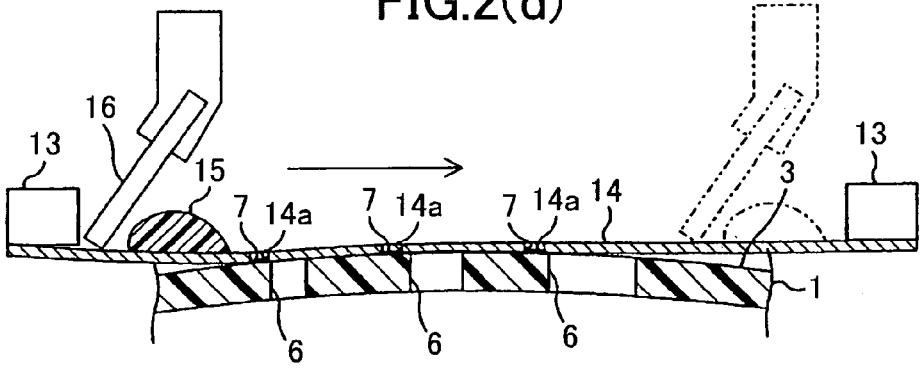
Figure 2E:
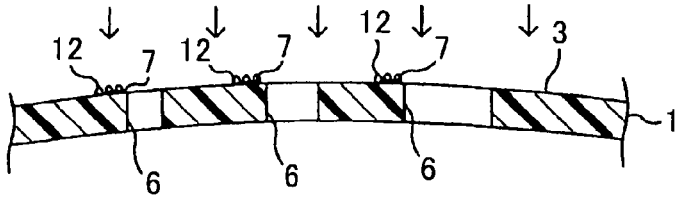

The molded component manufacturing method according to the present embodiment is directed to manufacturing an operation panel 1 which is mounted on an upper surface of a housing 20 of a laser printer 2 as shown in FIG. 1(*a*).

The laser printer 2 is an electronic device, and as shown in FIG. 1(*b*), includes: a control unit 30, a printing unit 32, a plurality of switches 17, and a liquid crystal display (LCD) 19, which are electronically connected with one another. The control unit 30 is for controlling the entire part of the laser printer 2. The switches 17 are manipulated by a user to input his/her instructions. An electronic instruction signal indicative of the user's instruction is supplied from the switches 17 to the control unit 30. The LCD 19 is for displaying settings information and the like of the laser printer 2. The printing unit 32 is for executing a predetermined printing operation in response to electronic control signals supplied from the control unit 30. The control unit 30 and the printing unit 32 are located inside the housing 20.

As shown in FIG. 1(*a*), the switches 17 and the LCD 19 are provided on an upper surface of the housing 20 of the laser printer 2. The operation panel 1 has: a display window 40 for exposing the LCD 19; and a plurality of switch openings 6 for exposing the plurality of switches 17, respectively. The operation panel 1 is mounted on the upper surface of the laser printer 2 to expose the LCD 19 through the display window 40 and to expose the switches 17 through the switch openings 6.

Figure 6:
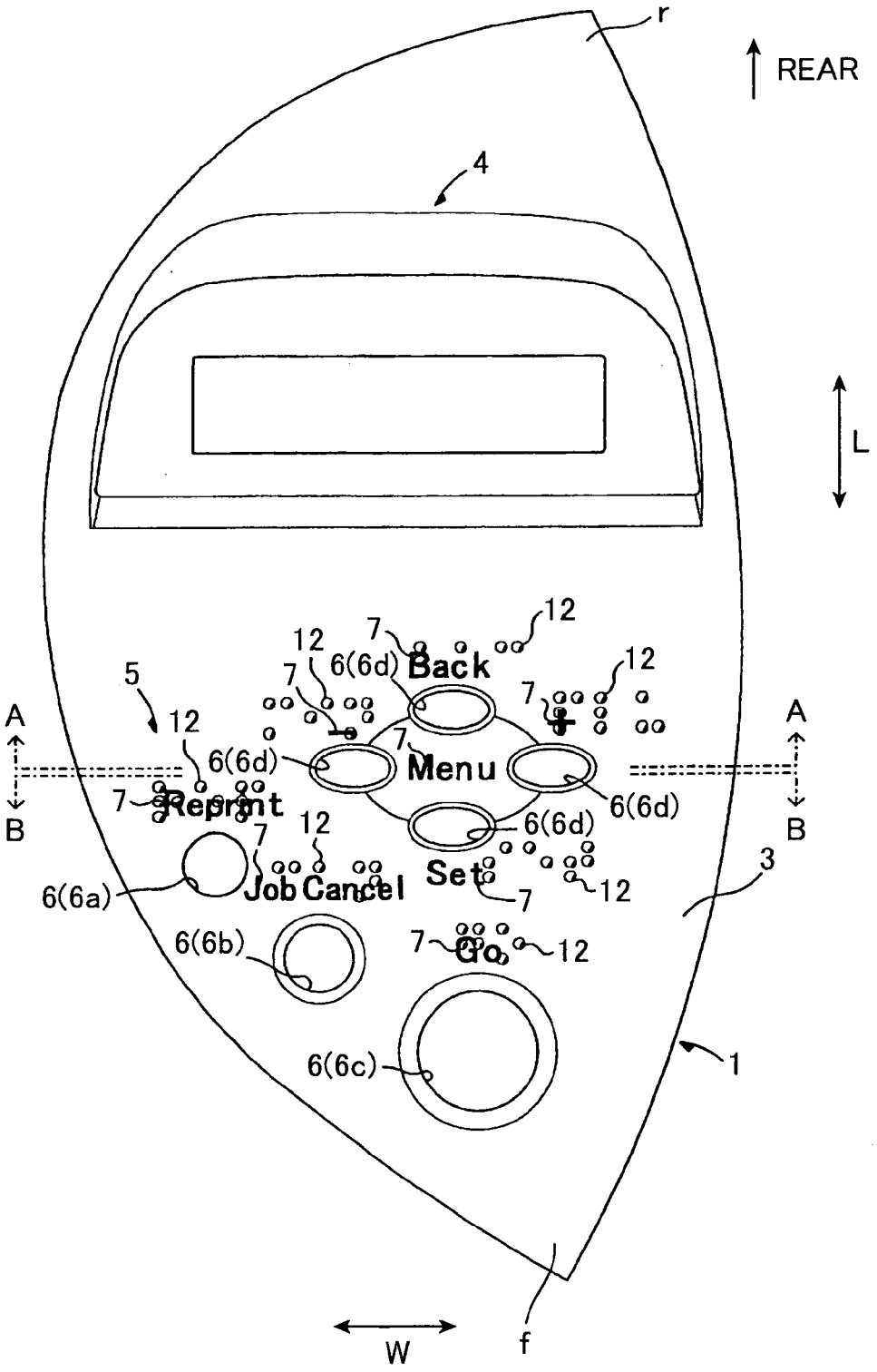
FIG. 6 is a plan view of the operation panel of FIG. 1 that is printed with both of the characters and Braille dots through the manufacturing processes of FIGS. 2(*a*)–2(*e*).

The laser printer 2 has a front portion F and a rear portion R. The operation panel 1 has a front end f and a rear end r. The operation panel 1 is mounted on the upper surface of the laser printer 2 while being oriented with its front end f being directed toward the front portion F of the laser printer 2 and with its rear end r being directed toward the rear portion R of the laser printer 2. The operation panel 1 is a molded component printed with characters 7 and Braille dots 12 as shown in FIG. 6.

FIGS. 2(*a*)–2(*e*) illustrate how to manufacture the operation panel 1 according to the present embodiment.

First, the operation panel 1 having a cross-section shown in FIG. 2(*a*) is prepared.

Figure 3:
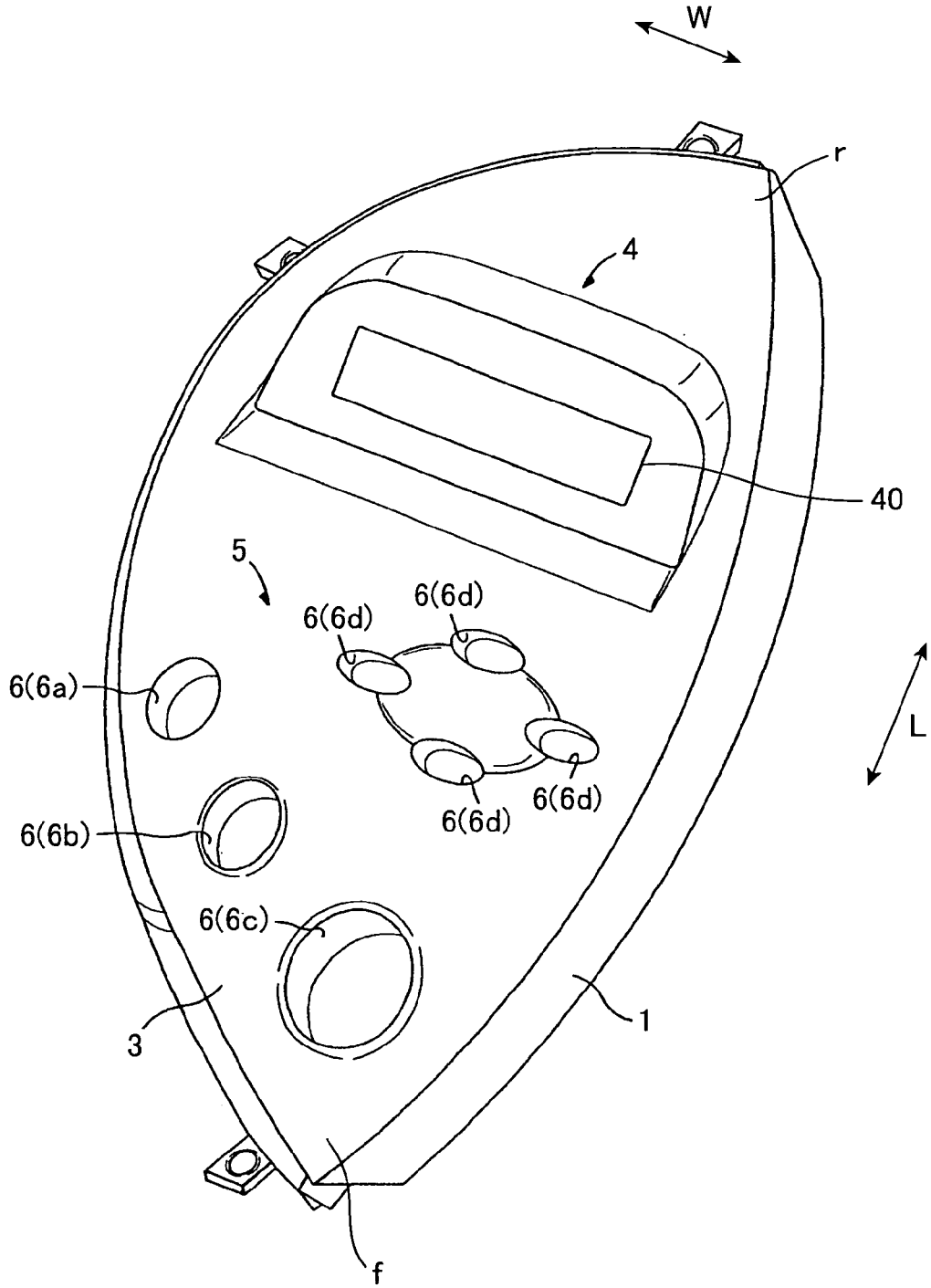
FIG. 3 is a perspective view showing the molded member for the operation panel.

More specifically, the operation panel 1 is molded by resin into a shape shown in FIG. 3 according to a known plastic molding method such as injection molding method or the like.

As shown in FIG. 3, the operation panel 1 has a plate shape. The operation panel 1 has an upper surface 3. The operation panel 1 is elongated between its front end f and its rear end r in its longitudinal direction L. The operation panel 1 has substantially a spindle-shape in its plan view. The operation panel 1 is curved upwardly at the center portion along the longitudinal direction L, and therefore is formed into an arc-like shape along the longitudinal direction L. Thus, the surface 3 is formed as a curved, arcuate surface. It is noted that the operation panel 1 is curved upwardly a little at the center portion also along a width direction W that is perpendicular to the longitudinal direction L.

During the molding process, the surface 3 of the operation panel 1 is formed as a rough grain surface having a large surface roughness. More specifically, tiny projections and tiny valleys or pits are distributed on the rough grain surface 3. The rough grain surface 3 therefore has a lower level defined by the bottom of the valleys and an upper level defined by the peaks of the projections. The difference D between the peaks and valleys is as large as about 50 μm in this example.

The operation panel 1 has: a display section 4 and an operation section 5. The display section 4 is provided with the LCD window 40. The LCD window 40 penetrates through the operation panel 1 in its thickness direction. As shown in FIG. 1(*a*), the LCD window 40 is for receiving the LCD 19 provided on the laser printer 2. The LCD window 40 is opened at an appropriate position for receiving the LCD 19, and has a size and shape appropriate for receiving the LCD 19.

The operation section 5 is provided with the plurality of switch openings 6. Each switching opening penetrates through the operation panel 1 in its thickness direction. As shown in FIG. 1(*a*), each switch opening 6 is for receiving a corresponding operation switch 17 provided on the laser printer 2. Each switch opening 6 is opened at an appropriate position for receiving a corresponding operation switch 17, and has a size and shape appropriate for receiving the corresponding operation switch 17. In this example, each switch opening 6 has a circular or elliptic shape in its plan view.

The switch openings 6 include; a first switch opening 6*a*, a second switch opening 6*b*, a third switch opening 6*c*, and four fourth switch openings 6*d*. The first through third switch openings 6*a*–6*c* are provided along a front edge of the operation panel 1. The first through third switch openings 6*a*–6*c* are opened to have circular shapes in their plan views such that their diameters increase in this order.

The four fourth switch openings 6*d* are arranged substantially in a rhombus form at a center part of the operation panel 1 in its longitudinal direction L. The fourth switch openings 6*d* are each opened in an elliptic shape elongated in the width direction W. Also, the operation panel 1 is curved upwards at the center part of the rhombus defined by the four fourth switch openings 6*d*.

Figure 4:
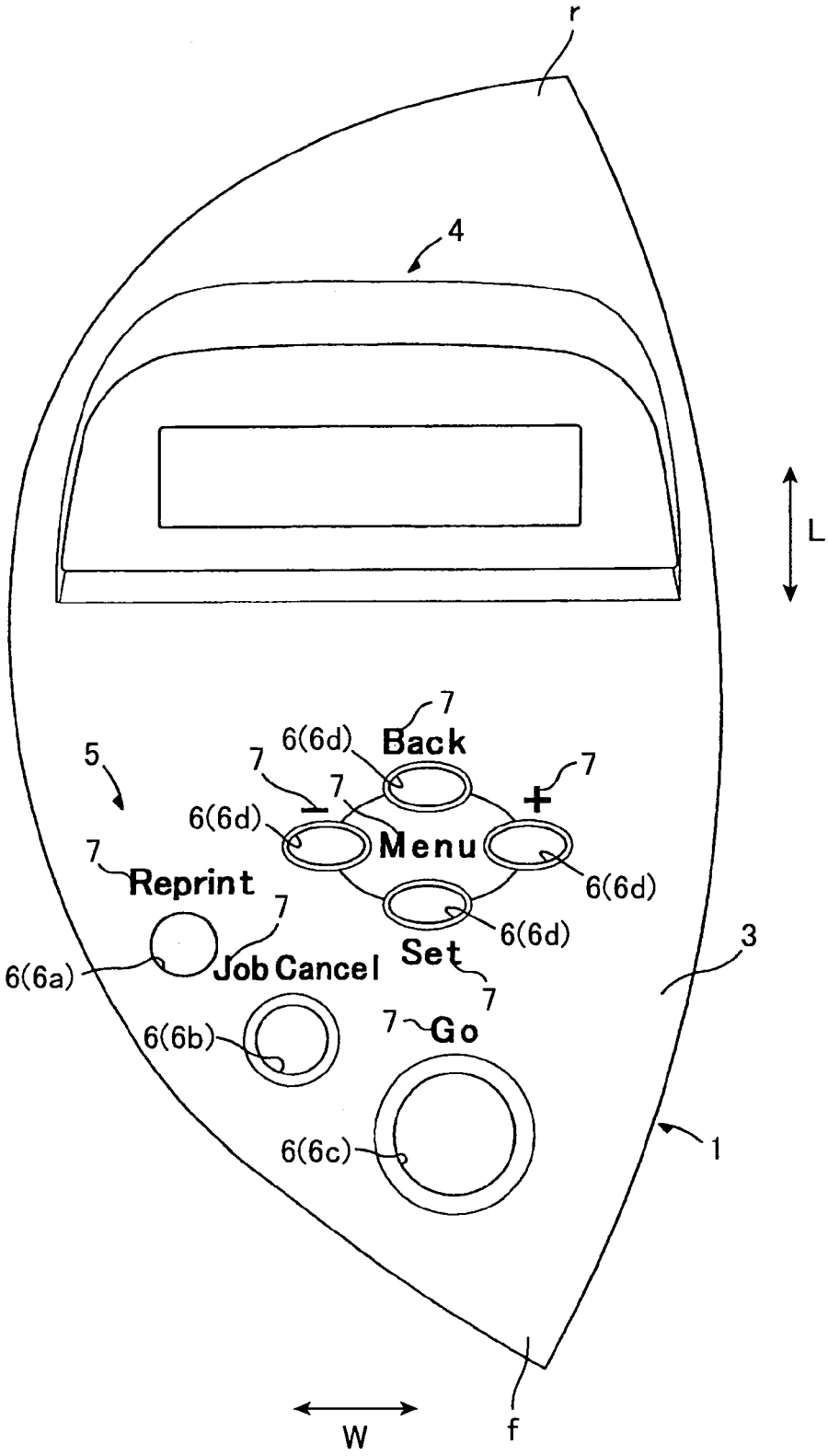
FIG. 4 is a plan view of the molded member printed with characters through the screen printing process of FIG. 2(*b*)

Next, a character printing process of FIG. 2(*b*) is executed to print characters 7 on the surface 3 of the operation panel 1 as shown in FIG. 4.

FIG. 4 is a plan view of the operation panel 1 obtained after the character printing process is executed. As shown in FIG. 4, a group of characters 7 is printed on the surface 3 of the operation panel 1 on the rear side of each switch opening 6 at a location adjacent thereto. The character group 7 indicates the type or kind of an operation switch 17 that is to be received in the corresponding switch opening 6. In this example, a letter string "Reprint" 7 is printed at a location on the rear side of and adjacent to the first switch opening 6*a*. A letter string "Job Cancel" 7 is printed at a location on the rear side of and adjacent to the second switch opening 6*b*. A letter string "Go" 7 is printed at a location on the rear side of and adjacent to the third switch opening 6*c*. A letter string "Back" 7, a letter string "Set" 7, a symbol "–" 7, and a symbol "+" 7 are printed at locations adjacent to the four fourth switch openings 6*d*, respectively. Each character group (letter string or symbol) 7 is positioned at a location that is sufficiently near to the corresponding switch opening 6 so that when a user' finger touches the character 7, the user's finger always touches the corresponding switch opening 6 simultaneously. It is noted that another letter string "Menu" 7 is further printed on the surface 3 of the operation panel 1 at a location in the center of the four fourth switch openings 6*d*.

The character printing process of FIG. 2(*b*) will be described below in greater detail.

As shown in FIG. 2(*b*), a screen sheet 9, fixed to a frame 8 with a slightly loose tension applied thereto, is mounted on the operation panel 1 so that the frame 8 confronts both ends of the operation panel 1 and so that the screen sheet 9 will be in contact with and will be slightly curved along the curved surface 3 of the operation panel 1. It is noted that the screen sheet 9 has a sufficiently wide area covering the entire operation section 5 on the surface 3 of the operation panel 1.

The screen sheet 9 will be described in more detail with reference to FIG. 5(*a*). As shown in an enlarged cross-sectional view of the screen sheet 9 of FIG. 5(*a*), the screen sheet 9 includes a screen 90 and a plate film (resist) 92 formed over the screen 90.

The screen 90 is formed by weaving fibers of silk, nylon, Tetron, or the like in a manner of plain weaving, diagonal weaving, satin weaving, or the like. In this example, the screen 90 is formed by weaving Tetron fibers with a mesh value (that is, the number of fibers per 1 inch (0.025 m)) of #300.

The plate film 92 is formed: by applying an emulsion over the screen 90; by opening print portions 9*a* through the emulsion by using a photographic method (optical method); and then finally hardening the emulsion. The print portions 9*a* are opened through the plate film 92 in its thickness direction in patterns of the characters 7 to be printed. The print portions 9*a* are formed at locations that are sufficiently near to the corresponding switch openings 6. That is, the distances between the print portions 9*a* and the corresponding switch openings 6 are sufficiently small so that the user's finger will touch the print portions 9*a* whenever the user's finger touches the corresponding switch openings 6.

It is preferable that the plate film 92 has a thickness of 25 to 30 μm. In this example, the plate film 92 has a thickness of 25 μm.

Figure 5A:
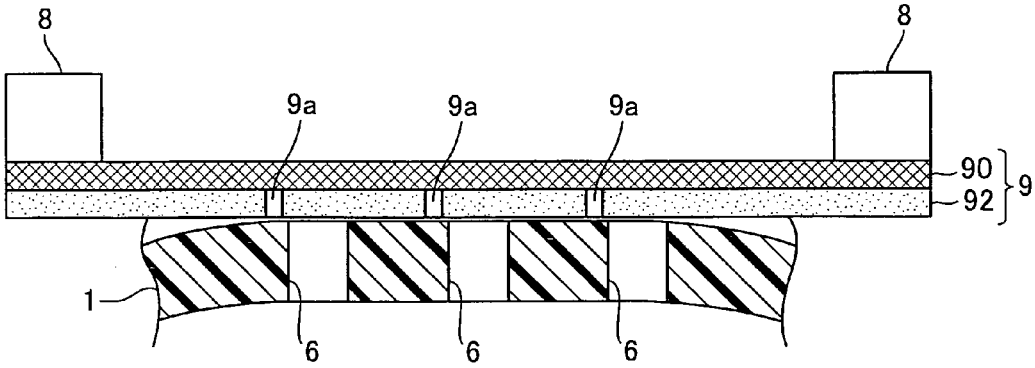
FIG. 5(*a*) illustrates an enlarged cross-section of a screen sheet used during the screen printing step of FIG. 2(*b*)
Figure 5B:
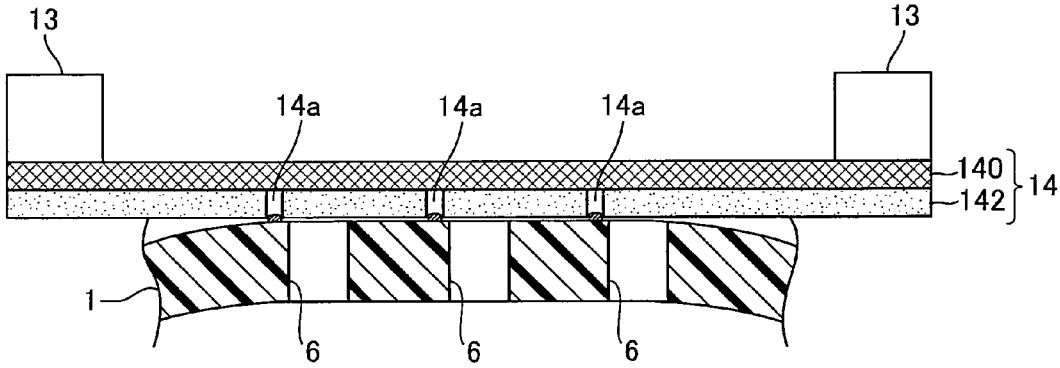

After producing the screen sheet 9 having the print portions 9*a* in the plate film 92 in a manner described above, the screen sheet 9 is fixed to the frame 8, and is mounted on the operation panel 1 as shown in FIG. 5(*a*). Then, solvent-type ink 11 is provided on the screen sheet 9 as shown in FIG. 2(*b*). A squeegee 10 made of a spatula-like rubber plate is moved over the screen sheet 9 while pressing the ink 11. As a result, ink 11 permeates through the screen 90 and through the print portions 9*a* of the plate film 92, and sticks to the surface 3 of the operation panel 1. In this manner, characters 7 are printed by ink 11 on the surface 3 of the operation panel 1 at locations near to the switch openings 6 as shown in FIG. 4.

It is noted that during the character printing process of FIG. 2(*b*), the squeegee 10 is moved once from left to right in FIG. 2(*b*). Accordingly, characters 7 of ink 11 are produced at each location to have a sufficiently large thickness that is identical to the thickness of the plate film 92. However, the characters 7 of ink 11 may be produced to have a desired larger thickness by moving the squeegee 10 plural times (two or three times, for example).

Next, as shown in FIG. 2(*c*), the solvent in ink 11 is volatilized at the normal temperature or by heating the ink 11 if necessary. As a result, the characters 7 are finally formed on the surface 3 of the operation panel 1 as shown in FIG. 4. These characters 7 have thickness approximately of several micrometers.

Next, a Braille printing processes of FIG. 2(*d*) is executed to print transparent Braille dots 12 on the surface 3 of the operation panel 1 as shown in FIG. 6.

FIG. 6 is a plan view of the operation panel 1 obtained after the Braille printing processes of FIG. 2(*d*) is executed. As shown in FIG. 6, seven groups of transparent raised dots (protrusions) 12 are provided as being overlapped on the seven groups of characters 7 of "Reprint", "Job Cancel", "Go", and "Back", "Set", "−", and "+" respectively. Each transparent-raised-dot group 12 is indicative of the same meaning as the character 7, over which the each transparent-raised-dot group 12 is provided.

The Braille-printing process of FIG. 2(*d*) will be described below in greater detail.

A screen sheet 14, fixed to a frame 13 with another tension applied thereto, is mounted on the operation panel 1 so that the frame 13 confronts both ends of the operation panel 1 and so that the screen sheet 14 will be in contact with and will be slightly curved along the curved surface 3 of the operation panel 1. It is noted that the screen sheet 14 is fixed to the frame 13 with a looser tension than when the screen sheet 9 is fixed to the frame 8. It is also noted that similarly to the screen sheet 9 (FIG. 5(*a*)), the screen sheet 14 also has a sufficiently wide area covering the entire operation section 5 of the surface 3 of the operation panel 1.

The screen sheet 14 will be described in greater detail with reference to FIG. 5(*b*). As shown in an enlarged cross-sectional view of the screen sheet 14 shown in FIG. 5(*b*), the screen sheet 14 includes a screen 140 and a plate film (resist) 142 formed over the screen 140.

Similarly to the screen 90 (FIG. 5(*a*)), the screen 140 is formed by weaving fibers of silk, nylon, Tetron, or the like in a manner of plain weaving, diagonal weaving, satin weaving, or the like with a mesh value smaller than that of the screen 90. In other words, the screen 140 is coarser than the screen 90. It is preferable that the screen 140 is three times coarser than the screen 90. That is to way, through-holes formed among adjacent fibers in the screen 140 are three times larger than through-holes formed among adjacent fibers in the screen 90. By using such a screen sheet 14, it is possible to easily produce Braille dots 12 lumpier and thicker than the characters 7. In this example, the screen 140 is formed by weaving Tetron fibers with a mesh value of #80.

Similarly to the plate film 92 (FIG. 5(*a*)), the plate film 142 is formed: by applying an emulsion to the screen 140; by opening print portions 14*a* through the emulsion by using a photographic method (optical method); and then finally hardening the emulsion. The print portions 14*a* are opened through the plate film 142 in its thickness direction in patterns of the Braille dots 12 to be printed. The print portions 14*a* are formed at such locations corresponding to the locations of the characters 7 already printed on the operation panel 1. Accordingly, the distances between the print portions 14*a* and the corresponding switch openings 6 are sufficiently small so that the user's finger will touch the print portions 14*a* whenever the user's finger touches the corresponding switch openings 6.

The thickness of the plate film 142 is greater than the plate film 92 (25 μm in this embodiment), and moreover greater than the difference D (50 μm in this embodiment) between the upper and lower levels of the grain surface 3 of the operation panel 1. For example, the plate film 142 preferably has a thickness of 200 to 500 μm. In this example, the plate film 142 has a thickness of 200 μm.

After producing the screen sheet 14 having the print portions 14*a* in the plate film 142 in a manner described above, the screen sheet 14 is fixed to the frame 13, and is mounted on the operation panel 1 as shown in FIG. 5(*b*). Then, transparent photo-curing resin 15, which is resin curable at normal temperature, is provided on the screen sheet 14 as shown in FIG. 2(*d*). In this example, transparent ultraviolet curing resin is used as the photocuring resin 15. A representative example of the transparent ultraviolet curing resin is "Thick medium HUGYO164" (trade name, manufactured by SEIKO ADVANCE. LTD.)

In the same manner as during the character printing process of FIG. 2(*b*), another squeegee 16 made of a spatula-like rubber plate is moved over the screen sheet 14, while pressing the ultraviolet curing resin 15. As a result, the ultraviolet curing resin 15 permeates through the screen 140 and through the print portions 14*a* of the plate film 142, and sticks to the surface 3 of the operation panel 1. In this manner, the ultraviolet curing resin 15 is printed in the form of Braille dots on the surface 3 of the operation panel 1 as overlapping the already-printed characters 7.

That is, the Braille dots 12 are printed at locations sufficiently close to the switch openings 6 so that the is user's finger will touch the Braille dots 12 whenever it touches the switch openings 6.

It is noted that the squeegee 16 is moved once from left to right in FIG. 2(*d*) during the Braille printing process of FIG. 2(*d*). Accordingly, Braille dots 12 of ultraviolet curing resin 15 are produced at each location to have a sufficiently great height that is identical to the thickness of the plate film 142. It is noted that the thickness of the plate film 142 is greater than the distance D between the upper and lower levels on the grain surface 3 of the operation panel 1. Accordingly, it is ensured that the raised amounts of the Braille dots 12 are greater than the raised amounts of the tiny protrusions formed on the grain surface 3. It is ensured that the user's finger will easily distinguish highly-raised Braille dots 12 from the tiny protrusions on the grain surface 3.

It is noted, however, that the Braille dots 12 of ultraviolet curing resin 15 may be produced to have a desired greater height by moving the squeegee 16 plural times (two or three times, for example).

Next, as shown in FIG. 2(*e*), ultraviolet rays are irradiated on the printed ultraviolet curing resin 15 at normal temperature, to set the ultraviolet curing resin 15. Thus, the Braille dots 12 are formed over the characters 7 on the surface 3 of the operation panel 1.

Conditions of irradiation of the ultraviolet rays are determined dependently on the size and irradiation amount of an ultraviolet lamp used. For example, an ultraviolet lamp is located at a predetermined distance (about fifty (50) mm) from the surface 3 of the operation panel 1, and the ultraviolet lamp is driven to irradiate ultraviolet rays onto the surface 3 of the operation panel 1 for about four (4) to five (5) seconds.

In this way, the ultraviolet curing resin 15 is hardened into the Braille dots 12 at normal temperature. It is unnecessary to execute heating operation. The operation panel 1 can be prevented from deformation and damages due to heating. In addition, the ultraviolet curing resin 15 is hardened speedily. Braille dots 12 can be produced speedily and therefore the productivity of the operation panel 1 is improved The thus formed Braille dots 12 have raised amounts (thickness) of about 300 μm.

In this way, the operation panel 1 is produced finally.

As described above, according to the present embodiment, a molded product for the operation panel 1 is produced by injection molding or the like. A set of characters 7 indicative of the type of each operation switch 17 is formed, by a screen printing process, at a location near to the subject switch opening portions 6. Next, another screen printing process is executed to form a set of Braille dots 12 indicative of each set of characters 7 at a location overlapping the subject set of characters 7. Accordingly, sticking spaces which are required in the case of sticking seals of the Braille dots 12 are unnecessary any more. The Braille dots 12 can be arranged freely in a narrow space. Even though the surface 3 of the operation panel 1 is curved, it is ensured that the Braille dots 12 be arranged in a secured layout, unlike the case of sticking a Braille tape on the surface 3.

The Braille dots 12 thus produced are in the form of projections. The surface of each Braille dot 12 has smaller surface roughness than that of the grain surface 3 of the operation panel 1. More specifically, the Braille dots 12 are formed from hardened resin, and therefore their surfaces touch smooth to the user's fingers. On the other hand, the surface 3 of the operation panel 1 is a grain surface and touches rough. Therefore, visually impaired user can easily sense, by fingers, the Braille dots 12 provided on the surface 3 of the operation panel 1, and can recognize the Braille dots 12 steadily.

Because the surface 3 of the operation panel 1 is formed as a grain surface, it is ensured to maintain an excellent outer appearance of the operation panel 1, while enabling the protrusions 12 to be sensed easily by the user's fingers.

The Braille dots 12 and characters 7 are printed as being overlapped one on another on the surface 3 of the operation panel 1. Therefore, the space for arranging the characters 7 and Braille dots 12 can be small and saved. Since transparent ultraviolet curing resin 15 is used for producing the Braille dots, the characters 7 can be observed though the Braille dots 12 as shown in FIG. 6.

Further, the productivity can be improved because both of the characters 7 and the Braille dots 12 are provided by the simple printing processes.

Further, the characters 7 and Braille dots 12 are not molded integrally with the operation panel 1, but are printed separately on the surface 3 of the operation panel 1. Therefore, a plurality of molded operation panels 1 may be produced from one same mold, and then may be easily modified into a plurality of different types of operation panels that suit for a plurality of different countries by simply printing the characters 7 and Braille dots 12 that comply with the languages and standards of the respective countries. Many different types of operation panels 1 can be produced from the same molded member by simply changing the characters 7 and Braille dots 12 in accordance with how the operation panels will be used.

If the Braille dots 12 were provided by sticking Braille seals onto the surface 3 of the operation panel 1, it will be necessary to provide the area or space for receiving a Braille seal at a location adjacent to each switch opening 6. In order to provide a set of Braille dots 12 adjacent to one switch opening 6, it is necessary to provide not only the area for the Braille dots 12, but also an additional area required for attaching the Braille seal. However, according to the present embodiment, because the Braille dots 12 are printed on the surface 3, it is unnecessary to provide such the additional area for sticking the Braille seal. Accordingly, the Braille dots 12 can be arranged freely even in a narrow space.

Additionally, if the Braille dots 12 were provided by sticking Braille seals onto the curved surface 3 of the operation panel 1, wrinkles will tend to be created when the seals are stuck to the surface 3 and the seals will easily peel off from their peripheral edges. However, according to the present embodiment, because the Braille dots 12 are printed on the curved surface 3, the above-described problems will not occur. It is ensured that the Braille dots 12 can be provided on the curved surface 3 in a desired layout.

In this way, according to the present embodiment, characters 7 and Braille dots 12 are efficiently provided on the surface 3 of the operation panel 1, and the operation panel 1 is produced efficiently.

As shown in FIG. 1(*a*), the operation panel 1 printed with the Braille dots 12 and the characters 7 is mounted on the upper surface of the laser printer 2. As a result, operation switches 17, provided on the laser printer 2, are properly received in the switch openings 6, respectively.

A user operates the operation switches 17 thus received in the operation panel 1. The Braille dots 12 are provided as overlapping the portions where the characters 7 are formed on the surface 3 of the operation panel 1. Accordingly, the Braille dots 12 are provided to each operation switch 17 at a location that is so close to the subject operation switch 17 that the user's finger will touch the subject operation switch 17 whenever the finger touches the Braille dots 12. It is ensured that every time a visually-impaired user touches some Braille dots 12, he/she can touch a corresponding operation switch 17. The user can properly manipulate his/her desired operation switches 17.

Additionally, both of the characters 7 and the Braille dots 12 are provided for each operation switch 17. Accordingly, the operation panel 1 is easy to understand for both of visually-non-impaired users and visually-impaired users, so that improved conveniences can be provided for both of them.

Because the characters 7 and Braille dots 12 are arranged efficiently on the operation panel 1, the laser printer 2 mounted with this operation panel 1 can have a smaller size with higher functions <Modification>

During the above-described character printing process of FIG. 2(*d*), the single screen sheet 14 covering the entire part of the operation section 5 is used. However, the operation section 5 may be divided into a plurality of regions. For example, as indicated by dot-and-chain lines in FIG. 6, the area where the letters 12 of "Menu" are printed is defined as a boundary, and the operation section 5 is divided into a backside region A and a front region B. During the Braille printing process of FIG. 2(*d*), two screen sheets 14 are prepared in one-to-one correspondence with the regions A and B. The Braille printing process of FIG. 2(*d*) therefore includes: a step where one screen sheet 14 for region A is mounted on region A to print Braille dots 12 on region A; and the other step where the other screen sheet 14 for region B is mounted on region B to print Braille dots 12 on region B. In this way, printing is carried out twice, each for a corresponding region. Thus, the Braille printing process is carried out more times than the number of times by which the character printing process of FIG. 2(*b*) is carried out because the character printing process of FIG. 2(*b*) is executed only once by using the screen sheet 9 that covers the entire operation section 5. By thus printing the Braille dots 12 in a divisional manner, the Braille dots 12 can be formed as sufficiently-highly-raised protrusions onto the curved surface 3 more reliably.

It is noted that the character printing process of FIG. 2(*b*) may be executed also in the divisional manner by dividing the operation section 5 into a plurality of areas, by preparing a plurality of screen sheets 9 in one to one correspondence with the plurality of regions, and by executing a plurality of steps for printing characters 7 onto the plurality of regions, respectively. By thus printing the characters 7 in a divisional manner, it is also ensured that the characters 7 can be formed onto the curved surface 3 more reliably.

It is more difficult to provide sufficiently highly-raised protrusions 12 on the curved surface 3 than to provide the smooth characters 7 on the curved surface 3. Accordingly, it is preferable to set the total number of the areas, into which the operation section 5 is divided during the Braille printing process of FIG. 2(*d*), to be greater than the total number of the areas, into which the operation section 5 is divided during the character printing process of FIG. 2(*b*). Accordingly, the total number of the printing steps executed during the Braille printing process of FIG. 2(*d*) will become greater than the total number of the printing steps executed during the character printing process of FIG. 2(*b*). By carrying out the printing of Braille dots more times than the number of times by which the printing of characters 7 is carried out, it is possible to provide the sufficiently-highly-raised protrusions 12 on the curved surface 3.

While the invention has been described in detail with reference to the specific embodiment thereof, it would be apparent to those skilled in the art that various changes and modifications may be made therein without departing from the spirit of the invention.

For example, in the above-described embodiment, the ultraviolet curing resin 15 is used during the screen printing process for the Braille dots 12. However, any other types of resin, such as electron-beam curing resin, two-fluid normal-temperature setting resin, or the like, may be used as long as the resin is hardened at normal temperature.

Also, in the above description, the Braille dots 12 are provided by the screen printing process. However, the Braille dots 12 may be formed by other types of printing method such as an inkjet printing method.

In the above-described embodiment, both of the characters 7 and Braille dots 12 are printed on the surface 3 of the operation panel 1. However, only the Braille dots 12 may be printed on the surface 3 of the operation panel 1. If necessary, the Braille dots 12 may be printed on other types of molded member mounted on the laser printer 2.

The Braille dots 12 may be printed on an operation panel or other molded member mounted on other types of electronic devices that execute certain performance electronically. Various types of protrusion other than the Braille dots may be printed on various types of molded member.

What is claimed is:

1. A method of producing a molded component, comprising:

defining at least one first region on at least a part of the entire surface of the molded member;

defining a plurality of second regions on the at least a part of the entire surface of the molded member, the total number of the plurality of second regions being greater than the total number of the at least one first region;

printing a character of ink on a surface of a molded member onto each first region; and forming a protrusion on the surface of the molded member onto each second region, on which the character has already been printed, wherein the forming the protrusion is performed more frequently than the printing the character on the surface of the molded member, and wherein the surface of the molded member is curved.

* * * * *